US008482227B2

(12) United States Patent
Lu

(10) Patent No.: US 8,482,227 B2
(45) Date of Patent: Jul. 9, 2013

(54) HOT CATHODE PREHEATING START DISCHARGE LAMP

(76) Inventor: Ching-Hsiang Lu, Hsinchu (TW)

( * ) Notice: Subject to any disclaimer, the term of this patent is extended or adjusted under 35 U.S.C. 154(b) by 491 days.

(21) Appl. No.: 12/911,733

(22) Filed: Oct. 26, 2010

(65) Prior Publication Data

US 2012/0098433 A1 Apr. 26, 2012

(51) Int. Cl.
*H01J 17/30* (2006.01)

(52) U.S. Cl.
USPC ..... 315/326; 315/330; 313/595

(58) Field of Classification Search
USPC ..... 315/105, 203, 204, 244, 246, 249, 315/261, 283, 326, 330–337, 358; 313/601, 313/631, 628, 602, 595, 547, 563–566, 627
See application file for complete search history.

(56) References Cited

U.S. PATENT DOCUMENTS 3,983,449 A * 9/1976 Dear et al. ..... 315/244
5,278,474 A * 1/1994 Nieda ..... 313/631

* cited by examiner

*Primary Examiner* — Jimmy Vu
*Assistant Examiner* — Borna Alaeddini
(74) *Attorney, Agent, or Firm* — Muncy, Geissler, Olds & Lowe, PLLC

(57) ABSTRACT

A hot cathode preheating start discharge lamp comprises a lamp tube, a first electrode, a second electrode, a first heating element and a second heating element. The lamp tube has a sealed housing chamber. The first and second electrodes have respectively one end held in the housing chamber and another end connected to a power source. The first and second heating elements are spaced from the first and second electrodes without connecting therewith and have respectively another end connected to a discharge preheating controller or an electronic ballast. Thereby the invention does not need tungsten filaments or electronic powder coated on the tungsten filaments to generate a great amount of electrons like the conventional techniques do. Thus the problems of burnout and fracture of the tungsten filaments or exhaustion of electronic powder can be eliminated, and the lifespan of the lamp tube can be enhanced.

8 Claims, 5 Drawing Sheets

HOT CATHODE PREHEATING START DISCHARGE LAMP

FIELD OF THE INVENTION

The present invention relates to a discharge lamp and particularly to a hot cathode preheating start discharge lamp.

BACKGROUND OF THE INVENTION

Ignition start of conventional discharge lamps generally adopts two approaches, i.e. hot cathode preheating start and cold cathode instant start. The discharge lamps adopted the cold cathode instant start include various types of high intensity discharge lamps and a cold cathode fluorescent lamp (CCFL) used as a backlight source for LCDs. Their start process is performed as follows: an ignition power source supplies electric power, and a ballast applies a high voltage to the electrodes at two ends of the lamp tube to ionize gas filled in the lamp tube to complete lamp ignition. Hence a rather high voltage must be provided to generate free electrons at a sufficient amount to conduct discharge current between the two electrodes.

Refer to FIG. 1 for a conventional hot cathode preheating start discharge lamp (commonly used for general fluorescent lamps or germicidal lamps). It includes a lamp tube 1 and two discharge electrodes 2 at two sides of the lamp tube 1. The lamp tube 1 is filled with a substance inside for discharging to emit light. Each of the two discharge electrodes 2 is connected to a tungsten filament 3 which is coated with a material having a low work function to easily emit electrons, and the material is commonly called electronic powder or cathode material. When ignition is started, the tungsten filament is electrically energized and heated to a temperature to emit a great amount of thermal electrons, then the ballast sends a high voltage between the two discharge electrodes 2 to generate discharge conduction to ignite the lamp tube 1 to complete ignition start process.

The lifespan of the hot cathode preheating start discharge lamp mainly depends on the two discharge electrodes. In the event that the electronic powder on the tungsten filament is consumed and exhausted by a great deal of sputtering or evaporation during the start process, or the tungsten filament is fractured to disconnect the heating power source, the discharge lamp cannot be ignited and becomes dysfunctional. In addition, each ignition process causes fierce impact of the electrodes by positive ions, which results in great sputtering of the electronic powder and huge consumption thereof. Empirical data show that each ignition process reduces the lifespan of the lamp by about 2-3 hours. On the other hand, a cold cathode discharge lamp has a non-helical tungsten filament for the electrode structure. Its ignition does not require a pre-heated process on the electrodes, but by directly applying a very high voltage on the two electrodes to generate very high electric field intensity between them to produce instant high voltage discharge to ignite the lamp tube. Hence a higher starting voltage is needed for lamp ignition. This creates a safety concern when in use. Compared with the cold cathode instant start discharge lamp, the hot cathode lamp has advantages of a lower starting voltage, lower energy consumption and greater safety. How to overcome the problems of the lower lifespan of the hot cathode discharge lamp and higher ignition starting voltage of the cold cathode discharge lamp is still an issue remained to be solved in the industry.

SUMMARY OF THE INVENTION

The primary object of the present invention is to solve the problems of the lower lifespan of the conventional hot cathode preheating start discharge lamp and higher starting voltage of the cold cathode instant start discharge lamp.

To achieve the foregoing object, the present invention provides a hot cathode preheating start discharge lamp which is connected to a power source and comprises a lamp tube, a first electrode, a second electrode, a first heating element and a second heating element. The lamp tube has a sealed housing chamber filled with a discharge light emitting material. The first and second electrodes have respectively one end held in the housing chamber and another end connected to the power source.

The first heating element has one end held in the housing chamber and spaced from the first electrode without connecting therewith and another end located outside the housing chamber. The second heating element also has one end held in the housing chamber and spaced from the second electrode without connecting therewith and another end located outside the housing chamber.

The power source, first electrode, first heating element, second heating element and second electrode are jointly formed a circuit. The first electrode and first heating element generate discharge between them to result in: first, the first electrode emits a great amount of thermal electrons at a high temperature to assist in discharge current conduction between the first electrode and second electrode; second, the discharge taken place between the first electrode and first heating element generates a great amount of electrons that also assist in discharge current conduction between the first electrode and second electrode; and third, the discharge taken place between the first electrode and first heating element also generates ultraviolet irradiating the illuminating gas to generate a great amount of photoelectrons to assist in discharge current conduction between the first electrode and second electrode. The same effect could also be taken place between the second electrode and second heating element.

By means of the structure and technique set forth above, the first and second heating elements heat the first and second electrodes respectively to generate discharge, such a discharge process generates a great amount of electrons to help ignition of the lamp. Therefore, the lamp can be ignited at a very low voltage without using the conventional tungsten filament. As a result, the invention can eliminate the problems of fracture of tungsten filament or exhaustion of electronic powder occurred in the conventional techniques, and the lifespan of the hot cathode preheating start discharge lamp is increased, and the starting voltage of the discharge lamp also is lowered.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
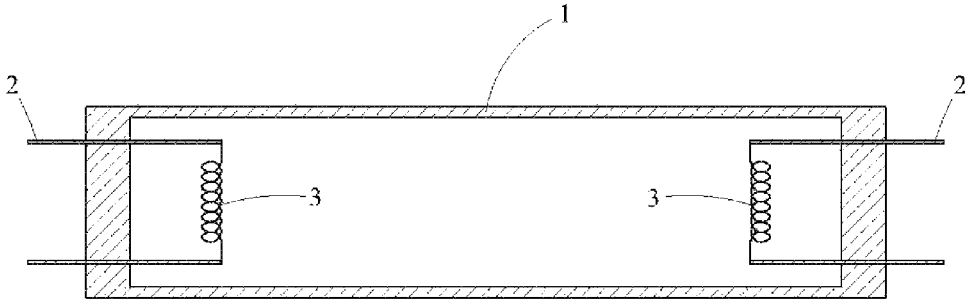
Fig.1 (PRIOR ART)
FIG. 1 is a schematic view of a conventional hot cathode preheating start discharge lamp.
Figure 2:
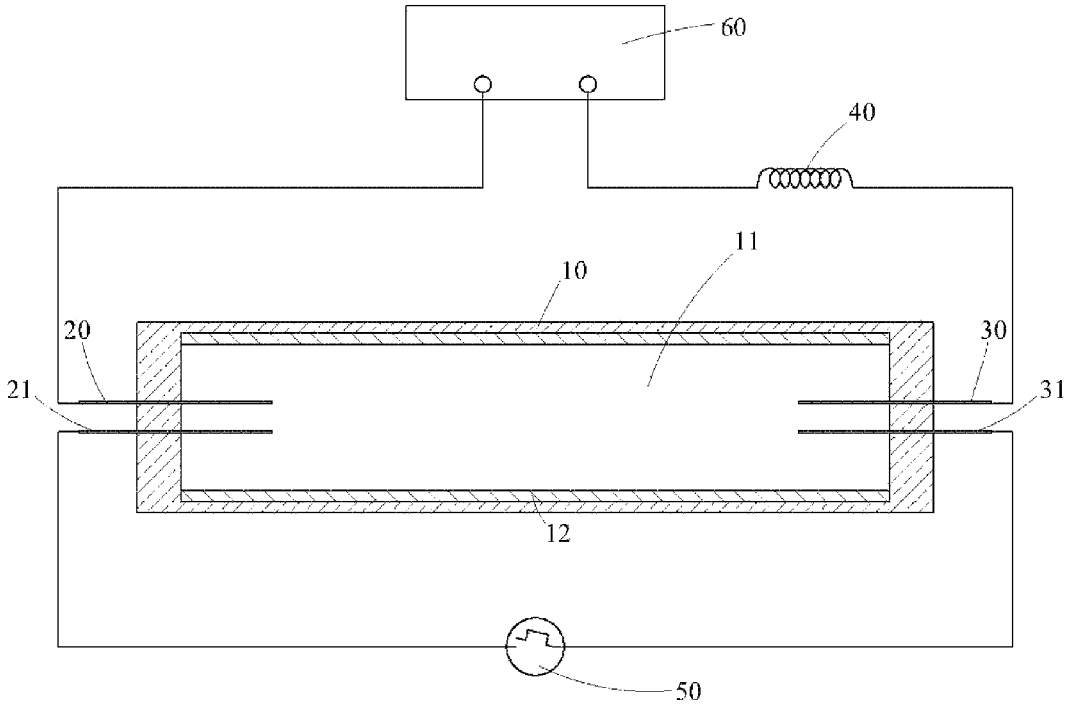
FIG. 2 is a schematic view of the structure of an embodiment of the invention.

Refer to FIG. 2 for an embodiment of the invention. The present invention provides a hot cathode preheating start discharge lamp which is connected to a power source 60 and comprises a lamp tube 10, a first electrode 20, a second electrode 30, a first heating element 21 and a second heating element 31. The lamp tube 10 has a sealed housing chamber 11 filled with a discharge light emitting material which is usually selected from the group consisting of inert gases such as neon (Ne), argon (Ar), krypton (Kr) and xenon (Xe) and mercury and combinations thereof. In this embodiment, the inner surface of the lamp tube 10 is coated with a fluorescent layer 12. The hot cathode preheating start discharge lamp also is connected to a discharge preheating controller 50 which may be a starter known in the art. The starter has two electrodes which are not directly connected when the voltage is not applied. When the voltage is applied, the discharge preheating controller 50 is discharged to generate heat to form expansion and connection of the two electrodes thereof, thus the first heating element 21 and second heating element 31 are conducted. The first and second electrodes 20 and 30 are located at two ends of the lamp tube 10, and have respectively one end held in the housing chamber 11 and another end connected to the power source 60. It is to be noted that the two ends of the lamp tube 10 previously discussed is based on an elongate lamp tube 10 to facilitate exemplification. For a U-shaped lamp tube 10 or other types of lamp tube 10, the first and second electrodes 20 and 30 might be located on the same side of the lamp tube 10.

The first heating element 21 has one end held in the housing chamber 11 and spaced from the first electrode 20 without connecting therewith, and another end connected to the discharge preheating controller 50. The second heating element 31 also has one end held in the housing chamber 11 and spaced from the second electrode 30 without connecting therewith, and another end connected to the discharge preheating controller 50. It is to be noted that the second electrode 30 is connected to the power source 60 through a ballast 40.

The power source 60, first electrode 20, first heating element 21, discharge preheating controller 50, second heating element 31, second electrode 30 and ballast 40 are jointly formed a circuit. The first electrode 20 and first heating element 21 generate discharge because of electric field existing between them to produce heat and high temperature. The high temperature actuates the first electrode 20 to emit thermal electrons around the front end thereof to form an electron cloud. Next, the discharge also generates a great amount of electrons 70 spread between the first electrode 20 and first heating element 21. Furthermore, the discharge also generates ultraviolet irradiating the first electrode 20 and discharge light emitting material inside the lamp tube 10 to generate a great amount of photoelectrons. The Same effect could also be taken place between the second electrode 30 and second heating element 31. The discharge preheating controller 50 aims to control discharge start and stop time, discharge current amount and discharge power. When the discharge between the first electrode 20 and first heating element 21, and second electrode 30 and second heating element 31 has reached a preset time of the discharge preheating controller 50, the discharge preheating controller 50 instantly cuts off the power source of the circuit to stop discharging between the electrodes and heating elements. Meanwhile, the ballast 40 is inducted to generate a high voltage superposing the voltage of the power source 60 which is applied between the two electrodes 20 and 30. With the aid of the high voltage between the first and second electrodes 20 and 30 and electrons 70, discharge conduction can be easily taken place to complete ignition starting process.

Figure 3:
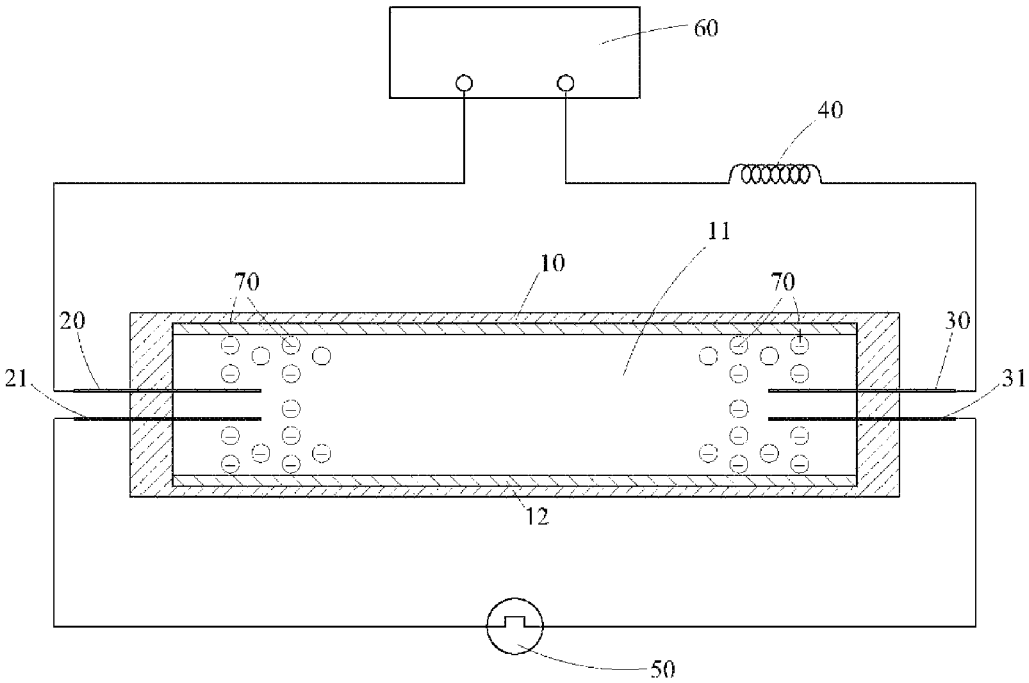
FIG. 3 is a schematic view showing generation of electron cloud of an embodiment of the invention.
Figure 4:
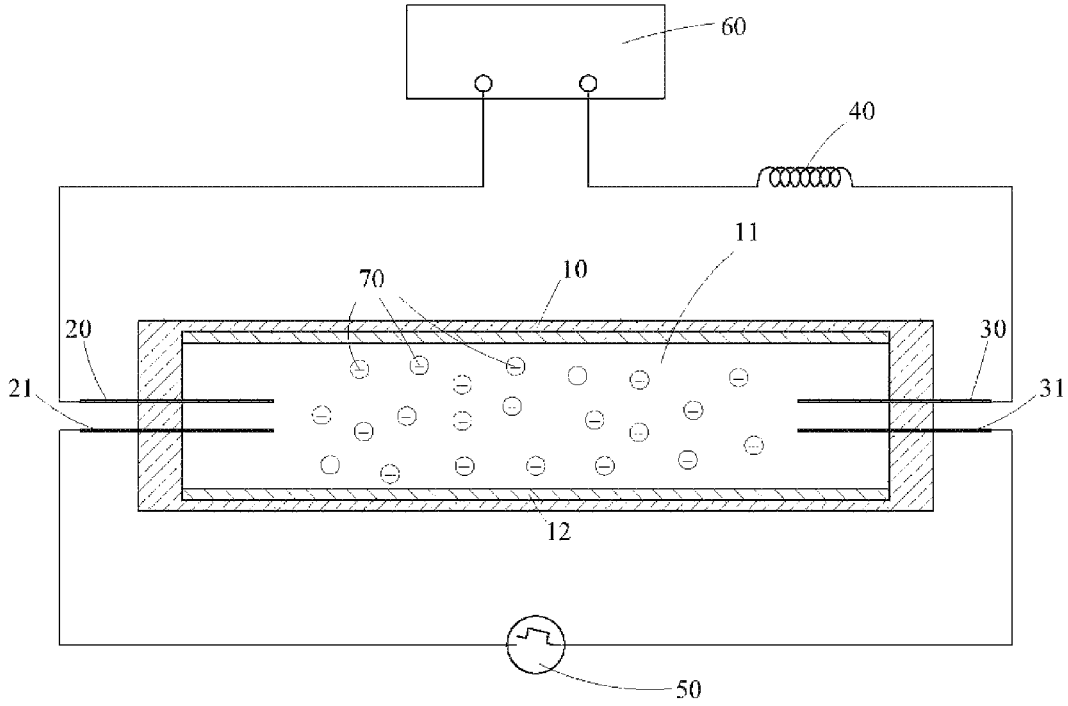
FIG. 4 is a schematic view showing electron movement of an embodiment of the invention.

Refer to FIGS. 3 and 4 for light emission process of the hot cathode preheating start discharge lamp of the invention. First, the power source 60 provides a voltage to induct electric field between the second electrode 30 and second heating element 31 and generate discharge between them, thus a high temperature is generated on the second electrode 30. When the electrode temperature reaches between 500° C. and 3400° C., a great amount of electrons 70 are emitted. The electrons 70 emitted by the raised electrode temperature are called thermal electrons to be distinguished from the original electrons 70. Similar condition could also be taken place between the first electrode 20 and first heating element 21. The discharge preheating controller 50 mainly controls discharge time and includes a delay circuit breaker and a current limiter. The delay circuit breaker controls mutual discharge time between the electrodes and heating elements, and terminates discharge current circuit at a desired time to allow the ballast 40 to induct high voltage to produce discharge conduction between the first electrode 20 and second electrode 30 in the lamp tube 10 to complete ignition start. The current limiter can be a resistor to restrict the maximum discharge current between the electrodes and heating elements to avoid burnout of the circuit from overcurrent. The discharge preheating controller 50 may also be substituted by a starter of a conventional fluorescent lamp. In this embodiment, in order to effectively increase generation of the electrons 70, the electrode temperature can be controlled between 500° C. and 3400° C. to allow the electrodes to emit a great amount of electrons 70, wherein 3400° C. is the melting point temperature of tungsten filament. Also referring to FIG. 4, the ballast 40 instantly inducts cutoff of the discharge preheating controller 50 and generates a high voltage superposing the voltage of the power source 60 to be sent between the first and second electrodes 20 and 30 to generate high voltage electric field. The high voltage electric field allows the electrons 70 to be moved toward the positive electrode direction at a high speed to hit and excite the discharge light emitting material in the lamp tube 10. Therefore, even more electrons 70 are generated to produce discharge conduction between the first and second electrodes 20 and 30 in the lamp tube 10, thereby to complete ignition start of the lamp and ignite the lamp tube 10. It is to be noted that once the first and second electrodes 20 and 30 have been conducted between them and the lamp has been ignited, the first heating element 21, second heating element 31 and discharge preheating controller 50 are no longer functionally needed.

In the aforesaid embodiment, the first heating element 21 is located close to the first electrode 20 in the housing chamber 11 at a distance between 0.1 mm and 30 mm. The second heating element 31 and second electrode 30 also are spaced from each other at the same close distance between 0.1 mm and 30 mm. The first electrode 20, second electrode 30, first heating element 21 and second heating element 31 are respectively made of material selected from the group consisting of tungsten, thorium tungsten, cerium tungsten, rhenium tungsten, molybdenum, nickel, aluminum, copper, iron and combinations thereof.

Figure 5:
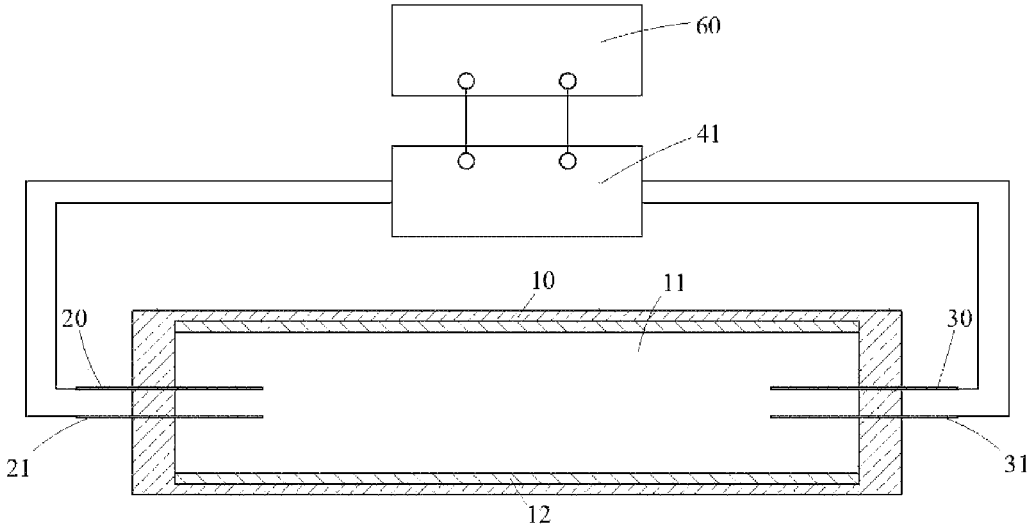
FIG. 5 is a schematic view of the structure of another embodiment of the invention.

Refer to FIG. 5 for another embodiment of the invention. Compared with the one previously discussed, the discharge preheating controller is omitted. The first electrode 20, first heating element 21, second electrode 30 and second heating element 31 are connected to power output contacts of an electronic ballast 41 which provides electronic preheating control function by setting preheating duration. First, the electronic ballast 41 sends a current simultaneously to the first electrode 20 and first heating element 21, and the second electrode 30 and second heating element 31 to generate discharge between them, thereby to increase the temperature of the first and second electrodes 20 and 30 between 500° C. and 3400° C. to emit a great amount of thermal electrons; then the electronic ballast 41 stops sending the discharge current, but sends a high voltage between the first and second electrodes 20 and 30 to generate discharge conduction between them in the lamp tube 10, thereby to complete ignition start of the lamp and ignite the lamp tube 10.

It is to be noted that the discharge ends of the first electrode 20, second electrode 30, first heating element 21 and second heating element 31 in the housing chamber 11 can be formed in a round bar shape, square bar shape, round hollow cup shape, square hollow cup shape or the like with a tungsten filament wound thereon or the tungsten filament coated with electronic powder. Another alternative is to fill the tungsten filament in the round or square hollow cup shape structure, or fill the tungsten filament and electronic powder to serve as a medium.

As a conclusion, by discharging and heating the first electrode 20 and second electrode 30 through the first heating element 21 and second heating element 31, and by through a design of spaced and non-contact electrodes and heating elements to generate ionization, thermal electrons, discharge electrons and photoelectrons are produced and clustered to become electrons 70, thereby to aid discharge conduction between the first electrode 20 and second electrode 30. As a result, the tungsten filament and electronic powder are not needed in the invention as the conventional techniques do, and the problems of fracture of tungsten filament or exhaustion of electronic powder can be eliminated, and the lifespan of the hot cathode preheating start discharge lamp of the invention is increased. Moreover, the safety concern caused by the high starting voltage of the cold cathode fluorescent tube can also be averted. The present invention can also be made at a lower cost, thus provides a significant improvement over the conventional techniques.

While the invention has been described by means of specific embodiments, numerous modifications and variations could be made thereto by those skilled in the art without departing from the scope and spirit of the invention set forth in the claims.

What is claimed is:

1. A hot cathode preheating start discharge lamp connected to a power source, comprising:

a lamp tube including a housing chamber filled with a discharge light emitting material;

a first electrode which is fastened to one end of the lamp tube including one end held in the housing chamber and another end connected to the power source;

a second electrode which is fastened to another end of the lamp tube including one end held in the housing chamber and another end connected to the power source;

a first heating element which is fastened to the lamp tube including one end held in the housing chamber spaced from the first electrode without connecting therewith and another end located outside the housing chamber; and a second heating element which is fastened to the lamp tube including one end held in the housing chamber spaced from the second electrode without connecting therewith and another end located outside the housing chamber.

2. The hot cathode preheating start discharge lamp of claim 1, wherein the second electrode is connected to the power source through a ballast.

3. The hot cathode preheating start discharge lamp of claim 1, wherein the second heating element and the first heating element are connected to a discharge preheating controller.

4. The hot cathode preheating start discharge lamp of claim 1, wherein the discharge light emitting material is selected from the group consisting of neon, argon, krypton, xenon, mercury and combinations thereof.

5. The hot cathode preheating start discharge lamp of claim 1, wherein the first electrode, the second electrode, the first heating element and the second heating element are respectively made of material selected from the group consisting of tungsten, thorium tungsten, cerium tungsten, molybdenum, nickel, aluminum, copper, iron and combinations thereof.

6. The hot cathode preheating start discharge lamp of claim 1, wherein the first heating element and the first electrode are held in the housing chamber and spaced from each other at a distance between 0.1 mm and 30 mm.

7. The hot cathode preheating start discharge lamp of claim 1, wherein the second heating element and the second electrode are held in the housing chamber and spaced from each other at a distance between 0.1 mm and 30 mm.

8. The hot cathode preheating start discharge lamp of claim 1, wherein the power source is connected to an electronic ballast which is electrically connected to the first electrode, the second electrode, the first heating element and the second heating element controlling discharge voltage and current amount, discharge voltage and current duration and switching thereof.

* * * * *